US009553360B1

(12) United States Patent
Huang et al.

(10) Patent No.: US 9,553,360 B1
(45) Date of Patent: Jan. 24, 2017

(54) HELIX ANTENNA DEVICE

(71) Applicant: GETAC TECHNOLOGY CORPORATION, Hsinchu County (TW)

(72) Inventors: Jia-Min Huang, Taipei (TW); Yen-Ching Lee, Taipei (TW)

(73) Assignee: Getac Technology Corporation, Hsinchu County (TW)

( * ) Notice: Subject to any disclaimer, the term of this patent is extended or adjusted under 35 U.S.C. 154(b) by 73 days.

(21) Appl. No.: 14/804,215

(22) Filed: Jul. 20, 2015

(51) Int. Cl.
*H01Q 11/08* (2006.01)
*H01Q 1/36* (2006.01)
*H01Q 9/27* (2006.01)

(52) U.S. Cl.
CPC ..... *H01Q 1/362* (2013.01)

(58) Field of Classification Search
CPC ..... H01Q 1/36; H01Q 1/362; H01Q 11/08; H01Q 11/083; H01Q 9/27
USPC ..... 343/895, 796; 361/719, 720, 736, 748, 361/749, 760, 761, 772, 777
See application file for complete search history.

(56) References Cited

U.S. PATENT DOCUMENTS 3,550,136 A * 12/1970 Jennetti ..... H01Q 11/08 343/742
3,641,580 A * 2/1972 Monser ..... H01Q 11/08 343/705
5,461,353 A * 10/1995 Eberhardt ..... H01F 17/0013 333/246
5,894,292 A * 4/1999 Everest, III ..... H01Q 1/1207 336/185
5,973,929 A * 10/1999 Arakawa ..... H05K 1/115 361/302
6,140,973 A * 10/2000 Annamaa ..... H01Q 1/242 343/725
6,229,489 B1 * 5/2001 Holshouser ..... H01Q 1/244 343/702
6,232,925 B1 * 5/2001 Fujikawa ..... H01Q 1/242 343/700 MS
6,337,670 B1 * 1/2002 Chen ..... H01Q 1/24 343/700 MS
6,434,369 B1 * 8/2002 Kanayama ..... H01Q 1/243 343/895
2001/0045914 A1 * 11/2001 Bunker ..... H01Q 3/242 343/895
2003/0210206 A1 * 11/2003 Phillips ..... H01Q 1/362 343/895
2006/0001591 A1 * 1/2006 Graggs ..... H01Q 1/288 343/895
(Continued)

*Primary Examiner* — Dameon E Levi
*Assistant Examiner* — Awat Salih

(57) ABSTRACT

A helix antenna device includes a board, a signal output circuit, a ground wire, and a helix antenna. The board includes first holes and second holes. The first holes are aligned to form a first row, and the second holes are aligned to form a second row. The signal output circuit is disposed on the board. The ground wire disposed on the board is between the first row and the second row and is connected to the signal output circuit. The helix antenna is rotationally passed through the first holes and the second holes so that it can surround a part of the area of the board. One end of the helix antenna is electrically connected to the signal output circuit. Thereby, it is convenient to have the helix antenna assembled to the board, and the structure parameters of the helix antenna are not easily influenced due to deformation.

9 Claims, 6 Drawing Sheets

(56) References Cited

U.S. PATENT DOCUMENTS

2006/0050009 A1* 3/2006 Ho ..... H01Q 1/362 343/895
2006/0214866 A1* 9/2006 Araki ..... G04G 21/04 343/788
2007/0120761 A1* 5/2007 Candal ..... H01Q 1/08 343/895
2007/0200786 A1* 8/2007 Takaoka ..... H01Q 1/1207 343/895
2007/0229383 A1* 10/2007 Koyanagi ..... H01Q 1/243 343/793
2008/0117120 A1* 5/2008 Su ..... H01Q 1/2283 343/895
2008/0224946 A1* 9/2008 Lee ..... H01Q 1/2283 343/895
2008/0231542 A1* 9/2008 Huang ..... H01Q 1/2266 343/895
2009/0015504 A1* 1/2009 Tsai ..... H01Q 1/2266 343/846
2009/0140946 A1* 6/2009 Ziolkowski ..... H01Q 7/00 343/788
2010/0085267 A1* 4/2010 Yun ..... H01Q 1/242 343/791
2010/0214184 A1* 8/2010 Tran ..... H01Q 1/2266 343/725
2011/0032174 A1* 2/2011 Sinnett ..... B60C 23/0493 343/885
2012/0026051 A1* 2/2012 Nilsson ..... H01Q 1/36 343/752
2012/0075165 A1* 3/2012 Liu ..... H01Q 1/242 343/895
2012/0119974 A1* 5/2012 Liu ..... H01Q 1/362 343/895
2013/0249752 A1* 9/2013 Alexopoulos ..... H01Q 1/38 343/745
2014/0111397 A1* 4/2014 Lim ..... H01Q 1/362 343/826
2014/0333504 A1* 11/2014 Basirat ..... H01Q 9/42 343/893
2015/0002335 A1* 1/2015 Hinman ..... H01Q 11/08 342/365
2015/0372374 A1* 12/2015 Judd ..... H01Q 1/08 244/172.6

* cited by examiner

HELIX ANTENNA DEVICE

BACKGROUND OF THE INVENTION

Field of the Invention

The instant disclosure relates to an antenna device, and more particularly, to a helix antenna device on a board.

Description of the Prior Art

Some electronic devices can be communicated to one another via certain communication means such as the global positioning system (GPS). The GPS utilizes 24 satellites on the orbits around the earth to broadcast GPS signals toward the ground for positioning application. A client with a GPS electronic device corresponding to the satellites can receive GPS signals from at least three satellites such that the position of the client can be calculated and derived. In order to achieve the wireless communication between the satellites and the GPS electronic device, the GPS electronic device has an antenna for receiving and transmitting signals. The types of antennas are varied. In the realm of GPS application, antennas of GPS electronic devices can be patch antennas or helix antennas. The bandwidths of patch antennas are relatively narrow, but the bandwidths of helix antennas are relatively wide. Consequently, helix antennas are better in light of reception of GPS signals.

However, materials of wire bodies of helix antennas are usually soft. Shapes and structures of helix antennas are unstable since helix antennas are easily deformed by external force. During the process of having a helix antenna assembled to an electronic device, the structural parameters such as the vertical separation or the pitch angle of the helix antenna are easily influenced if the helix antenna is pressed or impacted by external force applied by personnel or caused by accident. People having ordinary skill in the art shall understand that the quality of the signal reception and transmission may be influenced if the structure and the parameters of the helix antenna have some, even minor, changes. In order to accomplish the assembly process of helix antennas having well-designed structures without deformations, operators on production lines are required to be very carefully during assembling, and consequently they will spend a lot of time for doing so. Furthermore, personnel are also required to be very carefully to avoid impact during transport of the finished products. These requirements seem to be impractical.

To address the above issue, it is desperate to people in the art to find solutions regarding that helix antennas can be conveniently assembled to boards without deformations which can influence structural parameters of the helix antennas.

SUMMARY OF THE INVENTION

The present invention provides a helix antenna device. It is convenient to assemble a helix antenna to a board, and the structure parameters of the helix antenna are not easily influenced due to deformation.

To achieve the above objects, the present invention provides the helix antenna device comprising a board, a signal output circuit, a ground wire, and a helix antenna. The board comprises a plurality of first holes and a plurality of second holes. The first holes are aligned to form a first row, and the second holes are aligned to form a second row. The first row and the second row are parallel. The signal output circuit is disposed on the board. The ground wire is disposed on the board and is between the first row and the second row. The ground wire is connected to the signal output circuit. The helix antenna is rotationally passed through the first holes and the second holes so that it can surround a part of the area of the board. One end of the helix antenna is electrically connected to the signal output circuit.

According to an embodiment of the present invention, the apertures of the first holes and the second holes are substantially equal to the wire diameter of the helix antenna.

According to an embodiment of the present invention, a first distance is defined between the first holes adjacent to one another of the first row. The first distance is substantially equal to the vertical separation of the helix antenna.

According to an embodiment of the present invention, a second distance is defined between the second holes adjacent to one another of the second row. The second distance is substantially equal to the first distance. In addition, a third distance is defined between the first row and the second row. The third distance is substantially equal to the inner diameter of the helix antenna.

According to an embodiment of the present invention, the helix antenna is adapted to a working bandwidth. The working bandwidth comprises a highest frequency and a lowest frequency. The mean of the highest frequency and the lowest frequency is a center frequency. The difference of the highest frequency minus the lowest frequency is a bandwidth. The value of the center frequency divided by the bandwidth is in direct ratio to the third distance.

According to an embodiment of the present invention, the board comprises a front portion and a rear portion. The front portion is near the rear portion. The first holes and the second holes are at the front portion. The signal output circuit is at the rear portion.

Moreover, the board further comprises a front edge. The front edge is at a side of the front portion away from the rear portion. The first and the second rows each have one end near the front edge and another end near the rear portion.

According to an embodiment of the present invention, the signal output circuit comprises a filter and a low noise amplifier. The helix antenna is connected to the filter, and the filter is connected to the low noise amplifier.

The features of the present invention will no doubt become understandable to those of ordinary skill in the art after reading the following detailed description of the preferred embodiment that is illustrated in the various figures and drawings.

DETAILED DESCRIPTION OF THE EMBODIMENTS

Figure 1:
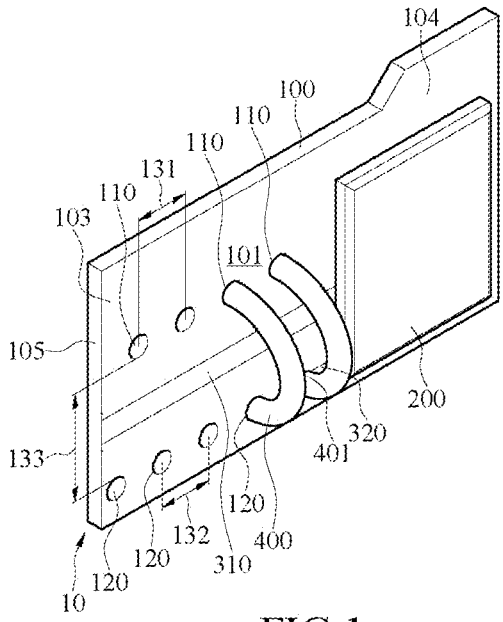
FIG. 1 illustrates a perspective view of one side of a helix antenna device according to an embodiment of the present invention.
Figure 2:
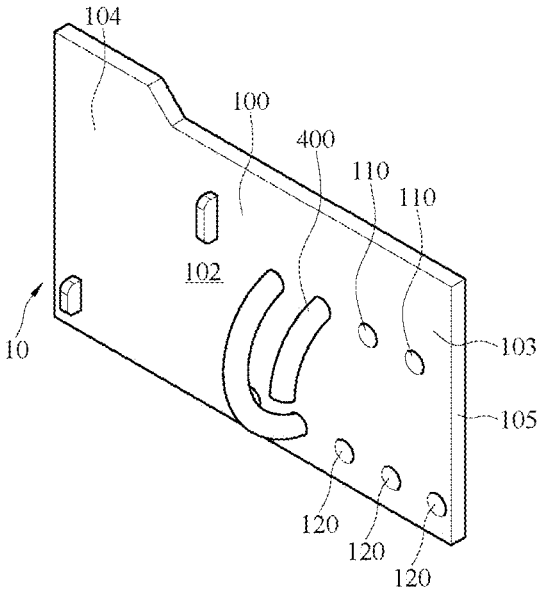
FIG. 2 illustrates a perspective view of another side of the helix antenna device according to an embodiment of the present invention.

Referring to FIG. 1 and FIG. 2, FIG. 1 is a perspective view of one side of a helix antenna device according to an embodiment of the present invention, and FIG. 2 is a perspective view of another side of the helix antenna device according to an embodiment of the present invention. In the embodiment, the helix antenna device 10 includes a board 100, a signal output circuit 200, a ground wire 310, and a helix antenna 400. The board 100 includes a first surface 101 and a second surface 102 opposite to each other. The board 100 further includes a plurality of first holes 110 and a plurality of second holes 120. In the embodiment, the first holes 110 and the second holes 120 penetrate the first surface 101 and the second surface 102 of the board 100. The first holes 110 are aligned to form a first row, and the second holes 120 are aligned to form a second row. The first row and the second row are parallel with each other.

The signal output circuit 200 is disposed on the board 100, which is utilized for being connected to a wireless module of a particular electronic device. Wireless signals (e.g., GPS signals) can be transmitted to the wireless module via the signal output circuit 200. The ground wire 310 is disposed on the board 100 and is between the first row and the second row. The ground wire 310 is connected to the signal output circuit 200. In the embodiment, the ground wire 310 is printed circuit. The helix antenna 400 is rotationally passed through the first holes 110 and the second holes 120 so that it can surround a part of the area of the board 100 and can be fixed to the board 100. The wire body of the helix antenna 400 passes through the first surface 101 and the second surface 102 of the board 100 such that the wire body of the helix antenna 400 is located at two sides of the board 100 at the same time. A head end 401 of the helix antenna 400 is electrically connected to the signal output circuit 200. The board 100 can be defined into a front portion 103 and a rear portion 104. As shown in FIG. 1, the front portion 103 is at the left side of FIG. 1, and the rear portion 104 is at the right side of FIG. 1. The front portion 103 is near the rear portion 104. The first holes 110 and the second holes 120 are at the front portion 103. The signal output circuit 200 is at the rear portion 104. Moreover, the board 100 further includes a front edge 105. The front edge 105 is at a side of the front portion 103 away from the rear portion 104. The first and the second rows each have one end near the front edge 105, and the first and the second rows each have another end near the rear portion 104 and near the signal output circuit 200.

Figure 3:
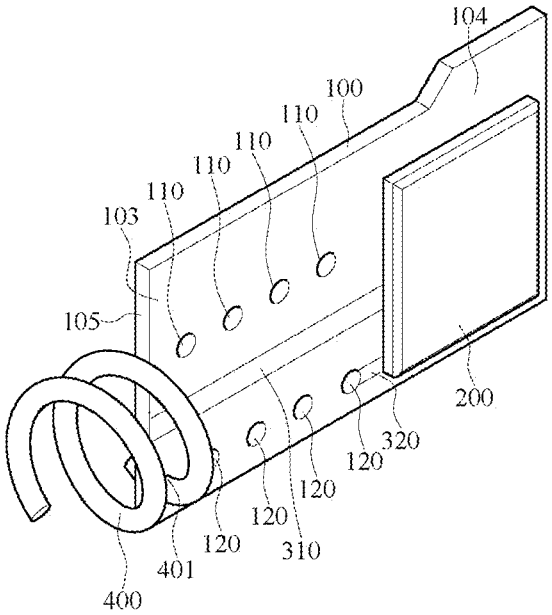
FIG. 3 illustrates a first stage of a process that a helix antenna is being assembled to a board according to an embodiment of the present invention.
Figure 4:
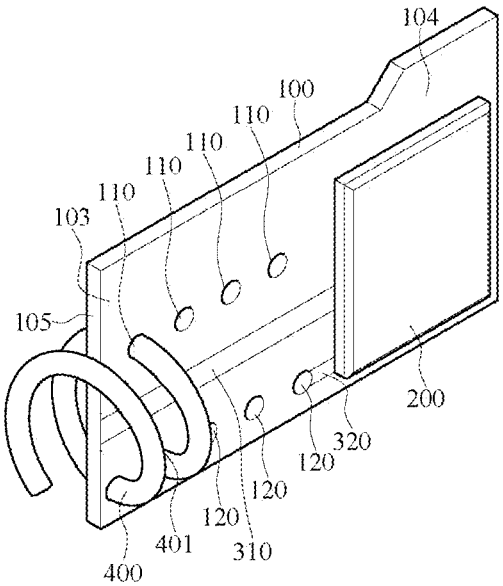
FIG. 4 illustrates a second stage of the process that the helix antenna is being assembled to the board according to an embodiment of the present invention.

Referring to FIG. 1, FIG. 3, and FIG. 4, FIG. 3 and FIG. 4 are respectively a first stage and a second stage of a process that the helix antenna 400 is being assembled to the board 100 according to an embodiment of the present invention. As shown in FIG. 3, the head end 401 of the helix antenna 400 is aligned with an initial hole in advance when the helix antenna 400 is going to be assembled to the board 100. The initial hole is the one of the first holes 110 and the second holes 120 the closest to the front edge 105 of the board 100. In the embodiment, the initial hole is the one of the second holes 120 of the second row the closest to the front edge 105. When the head end 401 of the helix antenna 400 is aligned with the initial hole, the helix antenna 400 can be rotated to pass through the first holes 110 and the second holes 120 in a clockwise direction (the direction is based on seeing from the left side to the right side of the FIG. 3). As shown in FIG. 4, the helix antenna 400 passes through the first holes 110 and the second holes 120 in sequence after the helix antenna 400 passes through the initial hole. Ultimately, the head end 401 of the helix antenna 400 passes through a terminal hole. As shown in FIG. 1, the terminal hole is the one of the first holes 110 and the second holes 120 the closest to the signal output circuit 200. A feeder circuit 320 is disposed on the first surface 101 of the board 100. The feeder circuit 320 is electrically connected to the signal output circuit 200 and the terminal hole. After the head end 401 of the helix antenna 400 is rotationally passed into the terminal hole, the head end 401 of the helix antenna 400 can be soldered in the terminal hole. As a result, the helix antenna 400 is electrically connected to the signal output circuit 200.

As shown in FIG. 1, in the embodiment, the helix antenna 400 stays in a part of the first holes 110 and the second holes 120 (the part that close to the signal output circuit 200) after the helix antenna 400 is completely assembled to the board 100. The helix antenna 400 is passed through the other part of the first holes 110 and the second holes 120 (the part that close to the front edge 105) during the assembling process and does not stay in those holes ultimately. In another embodiment, the total height (length) of the helix antenna 400 is enough high (long) so that the helix antenna 400 can stay in all of the first holes 110 and the second holes 120. In another embodiment, the total height (length) of the helix antenna 400 is much higher (longer) so that a part of the helix antenna 400 stays in all of the first holes 110 and the second holes 120, and the other part of the helix antenna 400 does not passed through the first holes 110 and the second holes 120. Furthermore, the part of the helix antenna 400 that stays in all of the first holes 110 and the second holes 120 and the other part of the helix antenna 400 that does not passed through the first holes 110 and the second holes 120 may each have distinctly different structural parameters such as different vertical separations and pitch angles. In the embodiment, the first holes 110 and the second holes 120 are not soldered except the terminal hole. In another embodiment, all of the first holes 110 and the second holes 120 in which the helix antenna 400 stays can be soldered to improve strength of fixation.

In the embodiment, the apertures of the first holes 110 and the second holes 120 are substantially equal to the wire diameter of the wire body of the helix antenna 400. As a result, the wire body of the helix antenna 400 can be fitted in and completely enclosed by the inner walls of the first holes 110 and the second holes 120. The strength of fixation between the helix antenna 400 and the board 100 can be strengthened. In another embodiment, the wire diameter of the wire body of the helix antenna 400 can be less than the apertures of the first holes 110 and the second holes 120, which makes it easier to have the helix antenna 400 assembled to the board 100. And the first holes 110 and the second holes 120 can still have the function of guiding and positioning to avoid deformation caused in assembling. In another embodiment, the wire diameter of the wire body of the helix antenna 400 can be slightly greater than the apertures of the first holes 110 and the second holes 120. The wire body of the helix antenna 400 can be tightly fitted in and closely against the inner walls of the first holes 110 and the second holes 120 such that the strength of fixation between the helix antenna 400 and the board 100 can be further strengthened.

As shown in FIG. 1, in the embodiment, a first distance 131 is defined between the first holes 110 adjacent to one another of the first row. The first distance 131 is substantially equal to the vertical separation of the helix antenna 400. A second distance 132 is defined between the second holes 120 adjacent to one another of the second row. The second distance 132 is substantially equal to the first distance 131.

The second distance 132 is also equal to the vertical separation of the helix antenna 400. In addition, a third distance 133 is defined between the first row and the second row. The third distance 133 is substantially equal to the inner diameter of the helix antenna 400.

Figure 5:
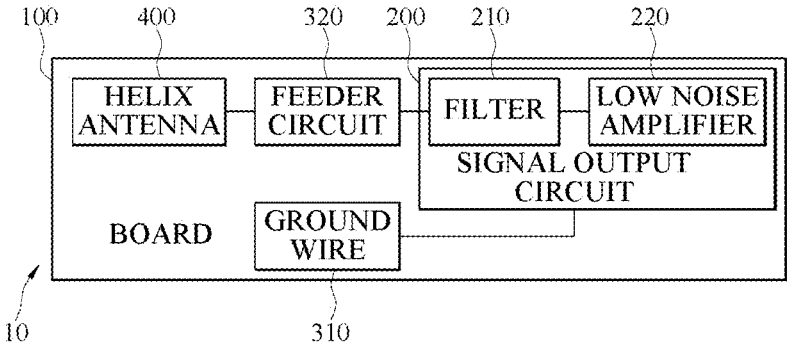
FIG. 5 illustrates a block diagram of the helix antenna device according to an embodiment of the present invention.

Referring to FIG. 5, FIG. 5 is a block diagram of the helix antenna device 10 according to an embodiment of the present invention. The helix antenna 400, the feeder circuit 320, the ground wire 310, and the signal output circuit 200 are disposed on the board 100. The signal output circuit 200 includes a filter 210 and a low noise amplifier 220. The helix antenna 400 is connected to the filter 210 via the feeder circuit 320. The filter 210 is connected to the low noise amplifier 330. The ground wire 310 is also connected to the signal output circuit 200. In the embodiment, the helix antenna 400 is used for signals feeding in. The helix antenna 400 is cooperated with the ground wire 310 in receiving signals with particular frequency/bandwidth. In the embodiment, the helix antenna 400 surrounds the board 100. In other words, the board 100 is at the middle of the helix structure of the helix antenna 400. As a result, the helix antenna device 10 can generate a radiation pattern with a shape more close to a circle. The helix antenna device 10 with such radiation pattern can receive signals from wider direction.

In the embodiment, the helix antenna 400 is adapted to a working bandwidth. The working bandwidth includes a highest frequency and a lowest frequency. The mean of the highest frequency and the lowest frequency is a center frequency. The difference of the highest frequency minus the lowest frequency is a bandwidth. The value of the center frequency divided by the bandwidth is Q (i.e., quality factor). Table 1 illustrates three types of the helix antenna devices 10 (represented by a helix antenna device A, a helix antenna device B, and a helix antenna device C) and their measured values and calculated values. The wire bodies of the helix antennas 400 of the three types of the helix antenna devices 10 each have distinctly different inner diameters (i.e., the diameter). The three types of the helix antenna devices 10 of table 1 are analogous to the helix antenna device 10 shown in FIG. 1 to FIG. 5.

TABLE 1

Parameters, measured values, and calculated values of the helix antenna devices 10.

| | Helix antenna device A | Helix antenna device B | Helix antenna device C |
|---|---|---|---|
| Diameter (m) | 0.008 | 0.01 | 0.012 |
| Highest frequency (GHz) | 1.731635 | 1.72259 | 1.701485 |
| Lowest frequency (GHz) | 1.39697 | 1.403 | 1.41506 |
| Bandwidth (GHz) | 0.334665 | 0.31959 | 0.286425 |
| Center frequency (GHz) | 1.585 | 1.585 | 1.585 |
| Q | 4.736 | 4.959 | 5.534 |

As shown in table 1, the bandwidth is about 0.3 GHz according to the results of measure and calculation of the helix antenna devices 10 in the embodiment. The bandwidth in the embodiment is almost 10 times of that in the conventional ceramic antenna (about 0.03 GHz). In addition, the greater the inner diameter of the helix antenna 400, the higher the value of Q is. In other words, the value of Q is in direct ratio to the inner diameter of the helix antenna 400. Namely, the value of the center frequency divided by the bandwidth is in direct ratio to the third distance 133. If the inner diameter of the helix antenna 400 is decreased, the helix antenna 400 is adapted to a wider bandwidth.

Figure 6:
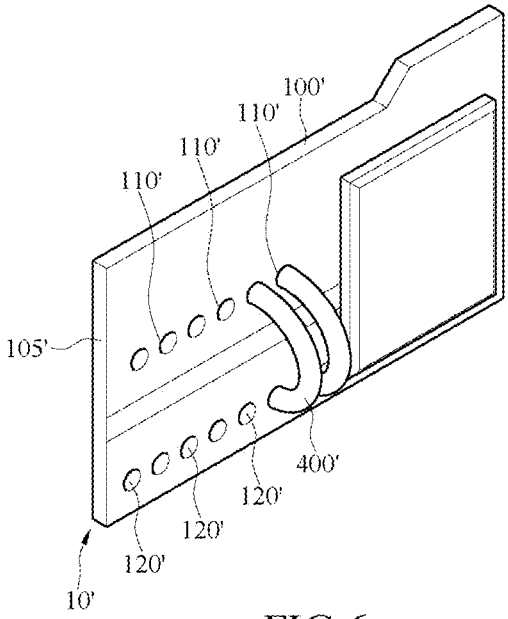
FIG. 6 illustrates a perspective view of a helix antenna device according to another embodiment of the present invention.

Referring to FIG. 6, FIG. 6 is a perspective view of a helix antenna device 10' according to another embodiment of the present invention. The helix antenna device 10' is similar to the helix antenna device 10 shown in FIG. 1 to FIG. 5. The distinctions between both are that distances between first holes 110' adjacent to one another of a board 100' of the helix antenna device 10' are less than the first distances 131. Similarly, distances between second holes 120' adjacent to one another are less than the second distances 132. The perpendicular distance between two rows of the first holes 110' and the second holes 120' is less than the third distance 133. In other words, a helix antenna 400' of the helix antenna device 10' has the vertical separation and the diameter less than those of the helix antenna 400. As a result, parameters and measured values of the helix antenna device 10' can be varied. In another embodiment, one of the first holes 110' the closest to the left side (referring to the direction of FIG. 6) is formed on a front edge 105', such that the one on the front edge 105' is not closed but has a breach. The inner wall of the first hole 110' on the front edge 105' is connected to the front edge 105'.

The helix antenna device of the instant disclosure is convenient to have the helix antenna assembled to the board, and the structural parameters of the helix antenna are not easily influenced due to deformation. Specifically, when the helix antenna device is further assembled to an electronic device, the helix antenna is not easily influenced due to pressing force or other external force based on the assistance of the board and the first holes and the second holes thereon. As a result, the structural parameters such as the vertical separation or the pitch angle of the helix antenna can be maintained so as to keep the characteristics of antenna and the efficiency of signal reception and transmission as the predetermined design.

While the present invention has been described by way of example and in terms of the preferred embodiments, it is to be understood that the present invention needs not be limited to the disclosed embodiments. For anyone skilled in the art, various modifications and improvements within the spirit of the instant disclosure are covered under the scope of the instant disclosure. The covered scope of the instant disclosure is based on the appended claims.

What is claimed is:

1. A helix antenna device, comprising: a board comprising a plurality of first holes and a plurality of second holes, the first holes being aligned to form a first row, the second holes being aligned to form a second row, the first row and the second row being parallel; a signal output circuit disposed on the board; a ground wire disposed on the board and between the first row and the second row, the ground wire being connected to the signal output circuit; and a helix antenna rotationally passed through the first holes and the second holes and surrounding a part of the area of the board, one end of the helix antenna being electrically connected to the signal output circuit.

2. The helix antenna device of claim 1, wherein the apertures of the first holes and the second holes are substantially equal to the wire diameter of the helix antenna.

3. The helix antenna device of claim 1, wherein a first distance is defined between the first holes adjacent to one another of the first row, and the first distance is substantially equal to the vertical separation of the helix antenna.

4. The helix antenna device of claim 3, wherein a second distance is defined between the second holes adjacent to one another of the second row, and the second distance is substantially equal to the first distance.

5. The helix antenna device of claim 1, wherein a third distance is defined between the first row and the second row, and the third distance is substantially equal to the inner diameter of the helix antenna.

6. The helix antenna device of claim 5, wherein the helix antenna is adapted to a working bandwidth, the working bandwidth comprises a highest frequency and a lowest frequency, the mean of the highest frequency and the lowest frequency is a center frequency, the difference of the highest frequency minus the lowest frequency is a bandwidth, and the value of the center frequency divided by the bandwidth is in direct ratio to the third distance.

7. The helix antenna device of claim 1, wherein the board comprises a front portion and a rear portion, the front portion is near the rear portion, the first holes and the second holes are at the front portion, and the signal output circuit is at the rear portion.

8. The helix antenna device of claim 7, wherein the board further comprises a front edge, the front edge is at a side of the front portion away from the rear portion, and the first and the second rows each have one end near the front edge and another end near the rear portion.

9. The helix antenna device of claim 1, wherein the signal output circuit comprises a filter and a low noise amplifier, the helix antenna is connected to the filter, and the filter is connected to the low noise amplifier.

* * * * *